United States Patent [19]

Langensiepen et al.

[11] 3,964,641

[45] June 22, 1976

[54] DEVICE FOR DISPENSING FLOWABLE MATERIALS

[75] Inventors: Gert Langensiepen, Runderoth; Werner Brüning, Wallefeld, both of Germany

[73] Assignee: Alfred Fischbach KG Kunststoff-Spritzgusswerk, Runderoth, Germany

[22] Filed: Oct. 2, 1974

[21] Appl. No.: 511,260

[30] Foreign Application Priority Data

Oct. 3, 1973 Germany ..... 2349656

[52] U.S. Cl. ..... 222/82; 222/83; 222/153; 222/389; 222/525

[51] Int. Cl.[2] ..... B67B 7/24

[58] Field of Search ..... 222/389, 82, 525, 153, 222/402.11, 541, 83

[56] References Cited

UNITED STATES PATENTS

| | | | |
|---|---|---|---|
| 1,667,782 | 5/1928 | Handelan | 222/525 X |
| 2,605,763 | 8/1952 | Smoot | 222/389 X |
| 2,766,913 | 10/1956 | Wilshusen | 222/402.11 |
| 2,818,999 | 1/1958 | Miller | 222/389 X |
| 3,136,456 | 6/1964 | Sherbondy | 222/389 X |
| 3,568,892 | 3/1971 | Burk | 222/389 X |
| 3,613,962 | 10/1971 | Boone | 222/389 |

*Primary Examiner*—Allen N. Knowles
*Attorney, Agent, or Firm*—Michael J. Striker

[57] ABSTRACT

A dispensing receptacle has an internal chamber in which a piston is accommodated and separates the chamber into two compartments. The material to be dispensed is accommodated in one of the compartments which communicates with the exterior of the receptacle via a dispensing arrangement. A container with pressurized medium is accommodated in the other compartment and has a valve which, when actuated, releases a predetermined quantity of the pressurized medium into the other compartment so as to act on the piston and displace the same toward the dispensing arrangement with a concomitant dispensing of the material. An actuating arrangement is provided for actuating the valve of the pressurized medium container. A foil originally separates the one compartment from the dispensing arrangement, and the dispensing arrangement is provided with a cutting projection which perforates the foil so as to establish communication between the one compartment and the dispensing arrangement. The dispensing arrangement includes a tubular valve member which has a closed end facing the one compartment provided in its circumferential wall with at least one opening and the valve member is mounted in an outlet opening for movement longitudinally of the receptacle between a closed position and an open position in which communication is established between the one compartment and an exterior of the receptacle via the opening in the circumferential wall of the valve member. The pressure prevailing in the one compartment urges the valve member toward its closed position.

19 Claims, 3 Drawing Figures

Fig. 1
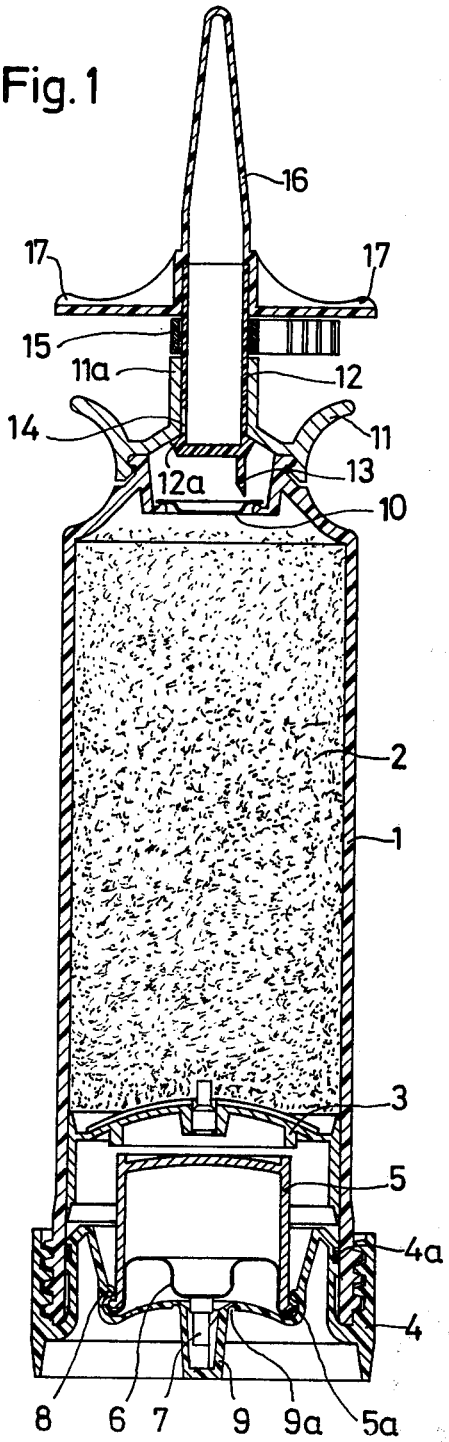
Fig. 2
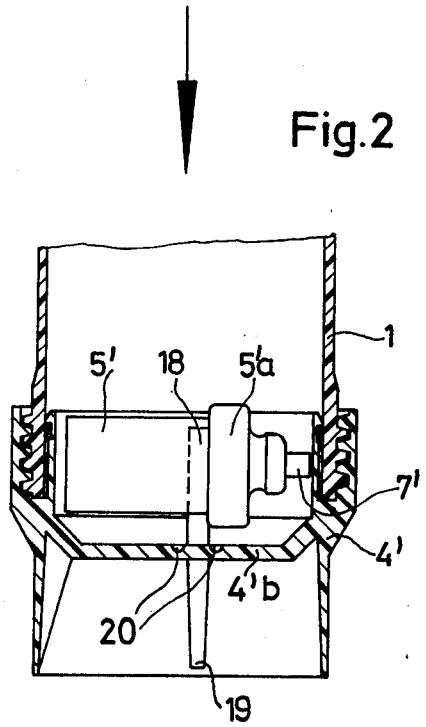
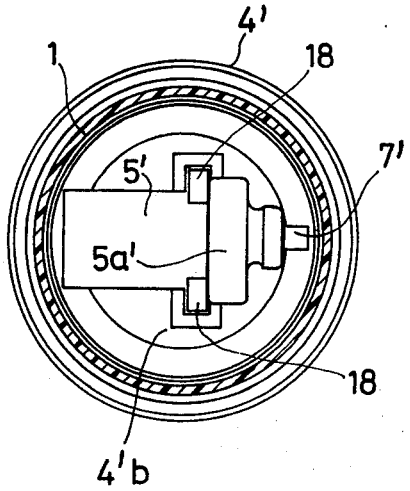
Fig. 3

DEVICE FOR DISPENSING FLOWABLE MATERIALS

BACKGROUND OF THE INVENTION

The present invention relates to a receptacle for dispensing flowable materials.

More particularly, the present invention relates to a dispensing receptacle which has a piston accommodated in an internal chamber thereof, and subdividing the same into two compartments.

There are already known receptacles which contain material to be dispensed, the contents of the container being under pressure. There are also already known various extrusion press arrangements for extruding a rope of permanently elastic material which is accommodated in the interior of the extrusion press arrangement. Such extrusion press arrangements find a widespread use in various fields of human endeavor, particularly in the construction industry, and serve for dispensing various materials such as sealing compounds, caulking compounds, putty or adhesives. Such extrusions press arrangements are used in situ, usually by actuating a piston which is accommodated in the interior of the extrusion press arrangement.

It has been heretofore known to manually actuate such piston and to displace the same in the direction toward the dispensing end of the extrusion press arrangement, which hereafter will be called a receptable. However, experience has shown that the manually operated extrusion press arrangements or receptacles are impractical in that a significant force is required for manually displacing the piston so that the user of such a receptacle cannot be expected to operate the receptacle for an extended period of time. In order to make the use of such receptacle easier, it is also already known to act mechanically on the piston by a special device connected to a source of pressurized fluid so as to displace the piston in the direction toward the dispensing end, thus extruding the rope of the permanently elastic material. However, it will be appreciated that such modified receptacles require for their operation a separate device and a source of pressurized fluid, such as pressurized air, which is not always available at the particular location at which the receptacle is to be used. It may also be seen that such receptacles, by necessitating the provision of the pressurized fluid source and connecting arrangements, are cumbersome and expensive to use.

SUMMARY OF THE INVENTION

Accordingly, it is an object of the present invention to avoid the disadvantages of the prior-art receptacles.

More particularly, it is an object of the present invention to provide a receptacle of the type here under discussion which is compact in construction and reliable in operation.

It is a further object of the present invention to provide a receptacle for extruding permanently elastic materials of the type accommodating a piston in its interior for separating the same into two compartments.

It is a concomitant of the present invention to provide such a receptacle which avoids the need for the expediture of an excessive manual force for the displacement of the piston, and also the need for the provision of an extraneous source of pressurized fluid.

A further object of the present invention is to provide a receptacle which is a self-contained unit and ready for use at any location and in any desired position.

It is yet a further object of the present invention to provide a receptacle equipped with safeguards against drying out of the contents and accidental or unauthorized use of the receptacle at least prior to the first use thereof.

In accordance with these objects and others which will become apparent hereafter, the receptacle according to the invention comprises, briefly stated, an elongated substantially cylindrical housing having a closed end and a dispensing end longitudinally spaced from the closed end and provided with a chamber; valve means connected to the dispensing end of the housing and operative for establishing communication between the chamber and the exterior of the housing; and a piston mounted in the chamber for displacement longitudinally of the housing and sealingly subdividing the chamber into a first compartment containing the material to be dispensed and communicating with the valve means, and a second compartment containing a pressurized medium for displacing the piston toward the valve means with attendant dispensing of the material through the latter. In the currently preferred embodiments of the invention, the pressurized medium is accommodated in a container situated in the second compartment and having a valve adapted to be actuated from the exterior of the housing so as to release a predetermined quantity of the pressurized medium into the second compartment.

In this manner, a self-contained compact receptacle is obtained which requires for the extrusion of the rope of the permanently elastic material at the desired location only the actuation of the outlet valve of the container for the pressurized medium, which requires only a minimum force. Hereby, the utilization of the receptacle is substantially facilitated and the receptacle can be used for extruding the material into spaces which have heretofore been inaccessible for the conventional extrusion receptacles.

In one of the currently preferred embodiments of the invention, a valve member is provided at the dispensing end of the receptacle, being accommodated in an outlet opening thereof and being connected to a dispensing nozzle in such a manner that the displacement of the dispensing nozzle in direction toward the receptacle and longitudinally thereof results in the opening of the valve member, while the valve member closes automatically due to the positive internal pressure prevailing in the receptacle. When such an arrangement is used, the handling of the receptacle is substantially simplified due to the fact that, for commencing the extrusion operation, the dispensing nozzle is simply and easily displaced longitudinally of the receptacle, while the internal pressure inside the receptacle automatically closes the outlet opening of the receptacle once the force acting on the dispensing nozzle has been discontinued.

In a further currently preferred embodiment of the invention, the pressurized medium container is supported on the inner walls of the closed end of the receptacle, which walls are made of an elastically yieldable material, the closed end of the receptacle being provided with an actuating member which may be so deformed as to actuate the outlet valve of the pressurized medium container.

It is also currently preferred that the pressurized medium container be cylindrical, coaxial with the receptacle, and provided with an annular bulge which engages an associated annular bulge on the interior wall of the closed end of the receptacle by snap action. In this embodiment, the closing wall of the closed end may be provided with a hollow projection, and the actuating element of the valve of the pressurized medium container may extend into the hollow projection which is elastically yieldable so that it may be deflected with attendant deflection and actuation of the valve of the pressurized medium container. In this manner, not only is a simplified construction of the receptacle obtained due to the fact that at least the closed end of the receptacle may be made of a synthetic plastic material in any known manner, particularly injection molded, but also the receptacle is very easy to handle since it is only necessary that the user of the receptacle deflects the hollow projection on the transverse closing wall of the closed end in order to, after opening the dispensing nozzle in the longitudinal direction of the receptacle, extrude the material from the receptacle in form of a rope.

In another currently preferred embodiment of the present invention, the pressurized medium container is again substantially cylindrical, but the longitudinal axis thereof is substantially normal to the longitudinal axis of the receptacle, and the outlet valve of the container is substantially coaxial with the container. In this embodiment, the interior wall of the closed end of the receptacle is formed with an abutment, and the transverse closing wall of the closed end is provided with an outwardly projecting actuating member and with an inwardly projecting bifurcated support element embracing the pressurized medium container and holding the same in such a position that the valve thereof faces the abutment. When the pressurized medium is to be discharged from the container, the outwardly projecting actuating member is deflected, thus deflecting the bifurcated support element and the container in direction towards the abutment so that the valve of the container contacts the abutment and is thereby prevented from further movement while the pressurized medium container continues such movement resulting in opening of the valve of the pressurized medium container. In this manner, a simple deflection of the outwardly projecting actuating member provided on the closed end of the receptacle causes the discharge of the pressurized medium into the compartment in which the pressurized medium container is accommodated so that the pressure of such a medium will act on the piston mounted in the receptacle for movement longitudinally thereof so that, once the discharge nozzle is opened, the material contained in the receptacle is discharged through the nozzle. Also in this embodiment, the closed end of the receptacle may be made of a synthetic plastic material so that the bifurcated support element and the outwardly projecting actuating member may be formed concurrently with the formation of the closed end of the receptacle, particularly if the same is formed by injection molding. Preferably, the support element elastically embraces the cylindrical pressurized medium container so that the insertion of the pressurized medium container into the support is greatly simplified. In this embodiment, it is also currently preferred that the transverse closed wall of the closed end be weakened in the region of the actuating member and of the support element for the pressurized medium container, whereby the elastic deflection of the actuating member together with the support element is improved with attendant facilitation of the handling of the device.

In accordance with a further preferred embodiment of the invention, an especially advantageous arrangement and operation of the dispensing nozzle with the valve member is obtained by forming the valve member as a tubular member which has a closed end facing into the interior of the receptacle, and a circumferential wall provided with apertures serving for establishing communication between the interior of the receptacle and the dispensing nozzle when the valve member is in its open position. The valve member is accommodated in an outlet sleeve for sliding movement, and the tubular valve member is provided with an annular projection in the region of its closed end, which annular projection cooperates with the outlet sleeve so as to interrupt communication between the interior of the receptacle and the exterior thereof when the valve member is in its closed position. The tubular valve member is connected to a dispensing nozzle which, in turn, is provided with hand grip portions accessible from the exterior of the housing, whereby the user of the receptacle may grasp the hand grip portions and displace the dispensing nozzle and also the valve member in the opening direction of the valve member and longitudinally of the receptacle until the apertures in the circumferential wall of the tubular valve member are at least partially located in the interior of the receptacle and establish communication between the same and the dispensing nozzle. In this manner, a reliable and simple actuating of the valve member is obtained by utilizing only a few coaxially arranged structural elements which may be simply produced from a synthetic plastic material so that an arrangement is obtained which is simple and compact in construction, easy to assemble, and easy to handle.

Advantageously, in this currently preferred embodiment of the invention, the tubular outlet sleeve is provided in a closure cap which may be connected by snap action to the discharge end of the receptacle, in which case the discharge end of the receptacle may be provided with a relatively thin foil which separates the contents of the receptacle from the exterior thereof and which may be easily perforated. In this event, the inner end of the discharge valve may be provided with a cutting projection which faces toward the foil when the closure cap is connected to the discharge end of the receptacle so that, when the receptacle is to be used for the first time, and the tubular valve member is displaced in its opening direction, the cutting projection penetrates the foil so that the contents of the receptacle may leave the same. Preferably, the cutting projection is axially parallel to the valve member but radially offset with respect thereto so that, by rotating the dispensing nozzle and thus the valve member, the original perforation may be enlarged in the circumferential direction of the receptacle and thus of the foil.

In an additional currently preferred embodiment of the present invention, there is provided between the outer end of the outlet sleeve and the end of the dispensing nozzle which faces the receptacle a safety ring which circumferentially surrounds the valve member and which is easily destructible. In this manner, any unintentional actuation of the dispensing nozzle and thus of the valve member with attendant accidental perforation of the foil are prevented. Thus, the presence of the safety ring is an indication of the fact that the receptacle has not been tampered with after leaving the factory.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a longitudinal section of a receptacle according to a first embodiment of the invention;

FIG. 2 is a partial longitudinal section of another embodiment of the invention generally corresponding to the section of FIG. 1 with that part of the receptacle which is the same as in FIG. 1 being omitted; and FIG. 3 is a cross-sectional view of the receptacle taken in direction of the arrow of FIG. 2.

DETAILED DESCRIPTION OF THE PREFERRED EMBODIMENTS

Referring now to the drawing, it may be seen that the cartridge shaped dispensing receptacle comprises a housing 1 partially filled with the material 2 which is to be extruded from the receptacle. The housing 1 may be made of a synthetic plastic material, and a piston 3, which may also be made of a synthetic plastic material, and which has a suitable configuration, is mounted in the interior of the housing for movement with respect thereto. The housing 1 is elongated and preferably cylindrical and has two ends, one of which is closed and at the other end of which the material 2 is extruded. The closed end of the housing 1 may be closed in any desired manner, for instance by forming the closure wall concurrently with forming the housing. However, in the drawings the closed end is shown as being closed by an internally threaded closure cap 4 which engages an external thread provided on the housing 1. The closure cap 4 may also be made of a synthetic plastic material, preferably by injection molding. The closure cap 4 gas-tightly closes the associated end of the housing 1, and a sealing element 4*a* is accommodated between the housing 1 and the closure cap 4 and seals the interior of the housing 1 with respect to its exterior.

In the illustrated embodiment, the closure cap 4 is pot-shaped and includes an outwardly projecting portion which is inwardly provided with an annular bulge 8 formed in the vicinity of the transverse wall of this projecting portion. The annular bulge 8 is provided with circumferentially spaced exteriorly extending grooves for passage of the pressurized medium.

The piston 3 subdivides the interior of the housing 1 into two compartments, one of which is located in the region of the closed end of the housing 1 and gas-tightly separated from the exterior of the receptacle. Pressurized medium container 5 which includes a lid 6 and an outlet valve 7 is situated in this compartment. The pressurized medium container 5 is provided in the vicinity of the lid 6 with a circumferentially extending annular bulge 5*a*. The circumferential bulge 5*a* engages with snap action behind the annular bulge 8 provided on the interior wall of the projecting portion of the closing cap 4 and is connected in this manner to the closing cap 4.

The projecting portion of the closing cap 4 is formed with a closing wall extending transversely to the longitudinal direction of the receptacle, and an elastically yieldable hollow projection 9 is formed on this transverse wall, and actuating portion of the outlet valve 7 of the pressurized medium container 5 extending into the hollow projection 9. Because of the pronounced elastic yieldability of the hollow projection 9, the same may be easily deflected transversely of the elongation of the receptacle so that the actuating portion of the outlet valve 7 of the pressurized medium container 5 is also deflected and the pressurized medium is discharged from the pressurized medium container 5 into the compartment in which the same is accommodated.

At the dispensing end of the housing 1, there is provided an opening which is closed by a foil 10, preferably an aluminum foil. In addition thereto, a closure cap 11 is connected by snap action to this dispensing end of the housing 1. The closure cap 11 is formed with an outlet sleeve 11*a*. In the outlet sleeve 11*a*, there is mounted for movement axially thereof a tubular valve member 12 which is provided with an annular projection 12*a*. The tubular valve member 12 is shown in FIG. 1 in its closed position in which the annular projection 12 abuts against the outlet sleeve 11*a*. The tubular valve member has a closed end which separates the interior of the valve member 12 from the interior of the housing 1. Apertures 14 are provided in the circumferential wall of the tubular valve member 12 which apertures 14 establish communication between the interior of the housing 1 and the interior of the valve member 11*a* when the latter is displaced longitudinally of the housing 1 in direction toward the closed end thereof. The tubular valve member 11*a* is further provided with a cutting projection 13 which, when the valve member 12 is displaced as described above for the first time, perforates the foil 10.

The tubular valve member 12 further includes an open free end, and a dispensing nozzle 16 is connected to this free end of the valve member 12 and communicates with the interior thereof. Similarly to all the other parts of the dispensing receptacle, also the dispensing nozzle 16 is illustrated in its configuration prior to the first use of the receptacle. The dispensing nozzle 16 is provided with lateral hand grip portions 17. Preferably, the dispensing nozzle 16 is pressure-fitted on the valve member 12. Finally, an easily destructible safety ring 15 is provided between the free end of the outlet sleeve 11*a* and the end of the dispensing nozzle 16 which faces the housing 1, the safety ring 15 surrounding the tubular valve member 12.

The operation of the dispensing receptacle will now be described. First of all, it is to be mentioned that the dispensing receptacle is shown in FIG. 1 in its condition prior to the first use thereof. In this condition, the receptacle is completely sealed off with respect to the exterior thereof and may be transported in this condition or stored for extended periods of time without any detriment to the contents thereof.

When the dispensing receptacle is to be used for the first time, the projecting tip of the dispensing nozzle 16 is severed in any conventional manner from the rest of the dispensing nozzle 16 so that communication is established between the interior and the exterior of the dispensing nozzle 16. Thereafter, the safety ring 15 is removed, and the user of the receptacle engages the hand grip portions 17 of the dispensing nozzle 16 and displaces the latter longitudinally of the receptacle in direction toward the closed end thereof. Since the valve member 12 is connected to the dispensing nozzle 16, it will share the displacement of the latter and will be pushed into the interior of the housing 1. As a result of this displacement, the apertures 14 establish communication between the interior of the housing 1 and the interior of the tubular valve member 12. Simultaneously, the cutting projection 13 penetrates the foil 10 providing a perforation therein. It is possible to circumferentially enlarge this perforation by rotating the dispensing nozzle 16 with attendant rotation of the valve member 12 and of the cutting projection 13 which is radially offset with respect to the axis of the valve member 12. In this manner, communication is established between the previously closed compartment of the housing 1 which accommodates the material to be extruded and the dispensing nozzle 16.

At this time, however, the material 2 is not under pressure since substantially atmospheric pressure exists in the compartment which accommodates the pressurized medium container 5. Thus, the material will remain inside the receptacle. In order to extrude the material 2, it is necessary to increase the pressure inside the compartment which accommodates the pressurized medium container 5. To achieve this, the elastically yieldable hollow projection 9 on the closing cap 4 is deflected transversely of the elongation of the housing 1 so that the actuating portion of the valve 7 of the pressurized medium container 5 is similarly transversely displaced with attendant opening of its outlet valve 7 and discharge of the pressurized medium, preferably gas, from the pressurized medium container 5 into the compartment of the housing 1 which accommodates the same. The elastic yieldability of the hollow projection 9 may be improved by providing a groove 9*a* around the same, thus weakening the closing wall of the closing cap 4 in this region. The released pressurized medium first enters the space between the lid 6 and the transverse closing wall of the closing cap 4, and then passes through the grooves in the annular bulge 8 and enters the space defined by the housing 1, the closing cap 4, and the piston 3, where it exerts pressure on the piston 3 and displaces the same longitudinally of the housing 1. The piston 3, in turn, exerts pressure on the material 2 which is thereby displaced longitudinally of the housing 1 toward the dispensing end thereof, through the accessible apertures 14 provided in the valve member 12 into the interior thereof, into the dispensing nozzle 16 and in form of a rope to the exterior of the dispensing receptacle. When the extrusion of the rope of the material 2 is to be discontinued, the user discontinues his engagement of the hand grip portion 17 whereafter the pressure of the material 2 on the closed end of the valve member 12 displaces the same axially thereof into the closed position thereof in which the circumferential projection 12*a* abuts against the outlet sleeve 11*a* with attendant interruption of the communication of the apertures 14 with the interior of the housing 1 so that no further material 2 can leave the receptacle. The material 2 is now under pressure which, however, may be insufficient for further extrusion thereof. Therefore, when the pressure acting on the piston 3 is too low, the elastically yieldable hollow projection 9 on the closing cap 4 is again deflected, thus discharging a further amount of the pressurized medium or gas into the compartment of the housing 1 in which the pressurized medium container 5 is accommodated.

FIGS. 2 and 3 illustrated a different embodiment of the dispensing receptacle according to the invention in which the location and actuation of the pressuried container is different from that shown in FIG. 1. The same reference numerals supplemented with a prime have been used to designate elements of the dispensing receptacle identical to those depicted in FIG. 1. The elements of the dispensing receptacle which have been omitted from FIGS. 2 and 3 can be structurally and functionally identical with those shown in FIG. 1.

In this embodiment, a closing cap 4′ is again sealingly screw-threaded on the closed end of the housing 1 and the closing cap 4′ is formed with a substantially planar bottom wall 4′*b*. A pressure medium container 5′ is again provided and it is substantially cylindrical and has a longitudinal axis which extends substantially normal to the longitudinal axis of the housing 1. The pressurized medium container 5′ is provided with a valve 7′ having an actuating projection, the valve and the actuating projection thereof extending substantially coaxially with the pressurized medium container 5′. A bifurcated support member 18 is provided which is connected to the bottom wall 4′*b*, and the pressurized medium container 5′ may be inserted with snap action into the bifurcated support member 18 so as to be embraced thereby. The pressurized medium container 5′ is formed with an annular bulge 5′*a* which forms a shoulder against which the bifurcated support member 18 abuts as shown in FIGS. 2 and 3.

In the region of the bottom wall 4′*b* where the bifurcated support member 18 is connected thereto, there is also provided an outwardly projecting actuating member 19. The closing cap 4′, the bifurcated support member 18 and the actuating member 19 are preferably manufactured in one piece, particularly of a synthetic plastic material, advantageously by injection molding. The bottom wall 4′*b* may preferably be formed with grooves 20 or similar indentations which weaken the bottom wall 4′*b* in the region in which the bifurcated support member 18 and the actuating element 19 are connected thereto.

As far as the operation of those elements of the dispensing receptacle which are not illustrated in FIGS. 2 and 3 is concerned, the handling of the dispensing receptacle is the same as previously described in connection with FIG. 1. However, when the pressurized medium, such as gas, is to be discharged from the pressurized medium container 5′ into the compartment in which the same is accommodated, the actuating element 18 has to be moved in one direction only, in FIG. 2 leftwardly, whereby the bifurcated support member 19 moves in the clockwise direction with attendant movement of the pressurized medium container 5′ and the valve 7′ rightwardly. When the actuating portion of the valve 7′ abuts against the inner wall of the housing 1, and the movement of the pressurized medium container 5′ is continued thereafter, the outlet valve 7′ is opened and the pressurized gas discharged from the pressurized medium container 5′ into the compartment accommodating the same, and defined by the housing 1, the piston 3 and the closing cap 4′. In this manner, the pressure inside this compartment is elevated, the piston 3 is displaced longitudinally of the housing 1 toward the dispensing end thereof, and the material 2 is expelled through the dispensing nozzle 16.

While the various parts of the receptacle have been disclosed as being preferably made of synthetic plastic materials, any other materials, for instance metals, can be used as well.

It will be understood that each of the elements described above, or two or more together, may also find a useful application in other types of dispensing devices differing from the types described above.

While the invention has been illustrated and described as embodies in a dispensing receptacle, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A dispensing receptacle comprising an elongated substantially cylindrical housing having a closed end and a dispensing end longitudinally spaced from said closed end, and provided with a chamber; valve means connected to said dispensing end of said housing and operative for establishing communication between said chamber and the exterior of said housing; a piston mounted in said chamber for displacement longitudinally of said housing and sealingly subdividing said chamber into a first compartment containing the material to be dispensed, and a second compartment; a substantially cylindrical container for a pressurized medium situated in said second compartment and connected to said housing coaxially therewith in the reginon of said closed end thereof, and having a valve formed with an actuating element; and actuating means including an elastically yieldable hollow projection extending centrally and exteriorly of said closed end, said actuating element of said valve of said container extending into said hollow projection and cooperating therewith so as to open said valve when said hollow projection is elastically deformed to thereby release a predetermined quantity of the pressurized medium into said second compartment for displacing said piston toward said valve means with attendant dispensing of said material through the latter.

2. A dispensing receptacle comprising an elongated substantially cylindrical housing having a closed end and a dispensing end longitudinally spaced from said closed end, and provided with a chamber; valve means connected to said dispensing end of said housing and operative for establishing communication between said chamber and the exterior of said housing; a piston mounted in said chamber for displacement longitudinally of said housing and sealingly subdividing said chamber into a first compartment containing the material to be dispensed, and a second compartment, said housing being formed with an annular bulge projecitg radially inwardly into said second compartment; a substantially cylindrical container for a pressurized medium situated in said second compartment and having a radially outwardly projecting annular bulge, said container being connected to said housing in the region of said closed end thereof by engagement of said bulges one behind the other with snap action, said container having a valve; and actuating means at said closed end of said housing accessible from said exterior of said housing and cooperating with said valve so as to open the same when said actuating means is actuated to thereby release a predetermined quantity of the pressurized medium into said second compartment for displacing said piston toward said valve means with attendant dispensing of said material through the latter.

3. A dispensing receptacle comprising an elongated substantially cylindrical housing having a closed end and a dispensing end longitudinally spaced from said closed end, and provided with a chamber; valve means connected to said dispensing end of said housing and operative for establishing communication between said chamber and the exterior of said housing; a piston mounted in said chamber for displacement longitudinally of said housing and sealingly subdividing said chamber into a first compartment containing the material to be dispensed, and a second compartment; a container for a pressurized medium situated in said second compartment and mounted at said closed end of said housing for displacement in a direction normal to the elongation of said housing, and having a valve formed with an actuating element extending in said direction; and actuating means at said closed end of said housing accessible from said exterior of said housing and cooperating with said container so as to displace the same in said direction when said actuating means is actuated whereby said actuating element of said valve of said container abuts against said housing and opens said valve of said container to thereby release a predetermined quantity of the pressurized medium into said second compartment for displacing said piston toward said valve means with attendant dispensing of said material through the latter.

4. A dispensing receptacle comprising an elongated substantially cylindrical housing having a closed end and a dispensing end longitudinally spaced from said closed end, and provided with a chamber; valve means connected to said dispensing end of said housing and operative for establishing communication between said chamber and the exterior of said housing; a piston mounted in said chamber for displacement longitudinally of said housing and sealingly subdividing said chamber into a first compartment containing the material to be dispensed, and a second compartment; a substantially cylindrical container for a pressurized medium situated in said second compartment and having a longitudinal axis, a radially outwardly projecting annular bulge, and a valve; and actuating means at said closed end of said housing and including a bifurcated support element connected to said closed end of said housing and engaging said container with snap action to that said longitudinal axis of said container extends transversely of said housing, and a projection on said closed end exteriorly of said housing and connected to said support element and cooperating therewith so that, when said projection is displaced, said support element engages said bulge and said container is displaced longitudinally thereof and said valve is opened to thereby release a predetermined quantity of the pressurized medium into said second compartment for displacing said piston toward said valve means with attendant dispensing of said material through the latter.

5. A dispensing receptacle comprising an elongated substantially cylindrical housing having a closed end including a closing wall extending transversely of the elongation of said housing, and a dispensing end longitudinally spaced from said closed end, and provided with a chamber; valve means connected to said dispensing end of said housing and operative for establishing communication between said chamber and the exterior of said housing; a piston mounted in said chamber for displacement longitudinally of said housing and sealingly subdividing said chamber into a first compartment containing the material to be dispensed, and a second compartment; a container for a pressurized medium situated in said second compartment and connected to said housing in the region of said closed end thereof, and having a valve; and actuating means connected to said closed end of said housing accessible from said exterior of said housing, said closing wall being provided with a recess in the region of connection of said actuating means to said closing wall and surrounding the former so that said closing wall is weakened in said region whereby said actuating means is mounted on said closing wall for elastically yielding with respect thereto when said actuating means is actuated, said actuating means cooperating with said valve so as to open the same when said actuating means is actuated to thereby release a predetermined quantity of the pressurized medium into said second compartment for displacing said piston toward said valve means with attendant dispensing of said material through the latter.

6. A dispensing receptacle comprising: an elongated substantially cylindrical housing having a closed end and a dispensing end longitudinally spaced from said closed end and provided with a chamber; valve means connected to said dispensing end of said housing and operative for establishing communication between said chamber and the exterior of said housing; a piston mounted in said chamber for displacement longitudinally of said housing and sealingly subdividing said chamber into a first compartment containing the material to be dispensed and communicating with said valve means, and a second compartment containing a pressurized medium for displacing said piston toward said valve means with attendant dispensing of said material through the latter; a container for the pressurized medium, situated in said second compartment and having a valve to be actuated from said exterior of said housing so as to release a predetermined quantity of the pressurized medium into said second compartment, said container being connected to said housing in the region of said closed end thereof, said closed end being formed with said actuating means cooperating with said valve so as to open the same when said actuating means is actuated.

7. A receptacle as defined in claim 6, wherein said container is substantially cylindrical and coaxial with said housing; wherein said actuating means includes an elastically yieldable hollow projection extending centrally and exteriorly of said closed end; and wherein said valve of said container is formed with an actuating element extending into said hollow projection and operative for opening said valve when said hollow projection is elastically deformed.

8. A receptacle as defined in claim 6, wherein said housing is formed with an annular bulge projecting radially inwardly into said second compartment; wherein said container is substantially cylindrical and is formed with a radially outwardly projecting annular bulge; and wherein said container is connected to said housing so that said bulges engage one behind the other by snap action.

9. A receptacle as defined in claim 6, wherein said container is mounted on said closed end for displacement in a direction normal to the elongation of said housing; and wherein said valve is formed with an actuating element extending in said direction and abutting against said housing when said container is so displaced whereby said valve is opened.

10. A receptacle as defined in claim 6, wherein said container is substantially cylindrical and has a longitudinal axis and a radially outwardly projecting bulge; and wherein said actuating means comprises a bifurcated support element connected to said closed end of said housing and engaging said container with snap action so that said longitudinal axis extends transversely of said housing, and a projection on said closed end exteriorly of said housing and connected to said support element and cooperating therewith so that, when said projection is displaced, said support element engages said bulge and said container is displaced longitudinally thereof.

11. A receptacle as defined in claim 6, wherein said closed end includes a closing wall extending transversely of the elongation of said housing; wherein said actuating means is connected to said closing wall; and wherein said closing wall is provided with a recess in the region of connection of said actuating means to said closing wall and surrounding the former so that said closing wall is weakened in said region whereby said actuating means is mounted on said closing wall for elastically yielding with respect thereto when said actuating means is actuated.

12. A receptacle as defined in claim 11, wherein at least said closing wall of said housing is made of an elastically yieldable synthetic plastic material.

13. A receptacle as defined in claim 6, wherein said dispensing end is formed with an outlet opening; and wherein said valve means includes a dispensing nozzle and a valve member connected to said dispensing nozzle and operative for establishing an interrupting communication between the latter and said first compartment, said valve member being mounted in said outlet opening for displacement longitudinally of said housing between a closed position and an open position when an external force is applied to said valve member, and between said open position and said closed position as a result of a positive internal pressure prevailing in said first compartment.

14. A receptacle as defined in claim 13, wherein said dispensing end is formed with an outlet sleeve defining said outlet opening and with a valve seat surrounding the latter, wherein said valve member is tubular and formed with a closed end facing said first compartment and an open end communicating with said dispensing nozzle, an annular projection abutting said valve seat when said valve member is in said closed position, and a tubular circumferential wall accommodated in said outlet opening and provided with at least one aperture establishing communication between said first compartment and the interior of said tubular valve member when the latter is in said open position thereof.

15. A receptacle as defined in claim 14, wherein said dispensing nozzle is formed with a handgrip portion.

16. A receptacle as defined in claim 14, wherein said outlet sleeve has a free end exteriorly of said housing and wherein said dispensing nozzle has an abutment surface facing said free end; and further comprising a removable safety ring intermediate said free end and said abutment surface and preventing unintended displacement of said dispensing nozzle and said valve member toward said open position of the latter.

17. A dispensing receptacle as defined in claim 6, wherein said housing includes a circumferential wall, and a transverse end wall rigidly connected to said circumferential wall at one end thereof and sealingly closing the latter; said valve means is connected to said circumferential wall at the dispensing end thereof, and is operative for separating the interior of said housing bounded by said walls from the exterior thereof and for establishing communication between said interior and said exterior; said second compartment is adjacent said end wall; said container for a pressurized medium is situated between said piston and said end wall of said housing and has a valve; and means are provided for mounting said container in said second compartment adjacent said end wall and means for actuating said valve of said container from the exterior of said housing so as to release a predetermined quantity of said pressurized medium from said container into said second compartment to act on said piston and displace the same toward said dispensing valve means when the material in said first compartment is to be dispensed through said dispensing valve member.

18. A receptacle as defined in claim 17, and further comprising a closure connected with snap action to said dispensing end of said housing and formed with an outlet opening, and a foil separating said first compartment from said outlet opening; and wherein said valve means includes a dispensing nozzle and a valve member connected to said dispensing nozzle and mounted in said outlet opening for displacement longitudinally of said housing between a closed position and an open position, said valve member being formed with a cutting projection extending into said chamber and adapted to perforate said foil during the initial displacement of said valve member toward said open position thereof so as to establish communication between said first chamber and said dispensing nozzle.

19. A dispensing receptacle comprising: an alongated substantially cylindrical housing having a closed end and a dispensing end longitudinally spaced from said closed end and provided with a chamber; valve means connected to said dispensing end of said housing and operative for establishing communication between said chamber and the exterior of said housing; a piston mounted in said chamber for displacement longitudinally of said housing and sealingly subdividing said chamber into a first compartment containing the material to be dispensed and communicating with said valve means, and a second compartment containing pressurized medium for displacing said piston toward said valve means with attendant dispensing of said material through the latter; a closure connected with snap action to said dispensing end of said housing and formed with an outlet opening, and a foil separating said first compartment from said outlet opening; said valve means including a dispensing nozzle and a valve member connected to said dispensing nozzle and mounted in said outlet opening for displacement longitudinally of said housing between a closed position and an open position, said valve member being formed with a cutting projection extending into said chamber and adapted to perforate said foil during the initial displacement of said valve member toward said open position thereof so as to establish communication between said first chamber and said dispensing nozzle.

* * * * *